US005715533A

United States Patent [19]

Stein

[11] Patent Number: 5,715,533

[45] Date of Patent: Feb. 10, 1998

[54] HEADGEAR

[76] Inventor: Michael Stein, Hauptstr. 241, 44649 Herne, Germany

[21] Appl. No.: 786,441

[22] Filed: Jan. 21, 1997

[30] Foreign Application Priority Data

| | | | |
|---|---|---|---|
| Jan. 31, 1996 | [DE] | Germany | 296 01 574.1 |
| May 9, 1996 | [DE] | Germany | 296 08 359.3 |
| May 31, 1996 | [DE] | Germany | 296 09 655.5 |

[51] Int. Cl.[6] ..... A42B 1/04

[52] U.S. Cl. ..... 2/7; 2/181; 2/209.13; 62/259.3; 607/110

[58] Field of Search ..... 2/7, 171.2, 181, 2/181.2, 181.6, 182.6, 209.13; 62/259.3, 259.4; 165/45; 607/96, 104, 108, 109, 110

[56] References Cited

U.S. PATENT DOCUMENTS 5,197,292 3/1993 McPherson ..... 2/7

*Primary Examiner*—Diana Biefeld
*Attorney, Agent, or Firm*—Henry M. Feiereisen

[57] ABSTRACT

A headgear to be worn on the head of a person, in particular a sunhat or a cap, includes a main body having an outer surface area exhibiting wettable properties over at least part thereof to define an evaporative zone, and a coolant supply unit for feeding a coolant from a coolant reservoir to the evaporative zone for permitting coolant to escape through evaporation, with the coolant supply unit including a tube connection linking the coolant reservoir to the evaporation zone of the main body.

25 Claims, 3 Drawing Sheets

HEADGEAR

BACKGROUND OF THE INVENTION

The present invention refers to a headgear to be worn on the head of a person, in particular a sunhat or a cap.

Sunhats or caps are generally used to protect the head and the body of a person from excessive sun radiation and sun glare. More sophisticated sunhats are equipped with small electrical fans that cool the person's head and are supplied with electric energy, e.g. from small solar cells mounted to the hat. As the solar cells for such headgear are generally very small and thus generate only low electric current, the electromotor generates only a very small output for driving the fan so that the cooling action of such headgear is unsatisfactory. Moreover, in particular during use on the beach, the electromotor can be damaged when coming into contact with sea water or sand.

SUMMARY OF THE INVENTION

It is an object of the present invention to provide an improved headgear obviating the afore-stated drawbacks.

In particular, it is an object of the present invention to provide an improved headgear which insures superior cooling action of the head in a simple manner while yet being reliable in operation without resorting to complicated mechanical or electrical components.

These objects and others which will become apparent hereinafter are attained in accordance with the present invention by providing a main body formed by a head covering portion and an outwardly extending brim, and having a free outer surface area exhibiting wettable properties over at least part thereof to define an evaporative zone, and a coolant supply unit for feeding a coolant from a coolant reservoir to the evaporative zone such that coolant is able to escape through evaporation, with the coolant supply unit including a tube connection linking the coolant reservoir to the evaporative zone of the main body.

By forming at least partially the main body of the headgear with areas of wettable material, the headgear exhibits an evaporative zone through supply of coolant, preferably water, so that latent heat can be carried off from inside the head covering portion of the headgear by means of evaporative cooling or directly from the skin of the person wearing the headgear. The coolant reservoir for supplying coolant to the evaporative zone can be integrated in the main body or formed by an external tank that is connected via a tube connection with the main body.

A headgear according to the present invention is extremely robust and does not exhibit any susceptible mechanical or electrical components. The effect of evaporative cooling is ensured even when the sun does not shine or the person wearing the headgear stands in the shade because evaporation occurs already at moderate air movement, even when the person wearing the headgear moves indoors in an enclosed room. It is certainly also possible to use as coolant a different fluid that more easily evaporates than water, for example alcohol.

Preferably, the external tank is a container carried on a person's body, for example in the form of a shoulder bag, belt, backpack, necklace or bracelet or part thereof. In order to convey coolant from the tank to the headgear, it is possible to set the tank under excess pressure, e.g. by means of air pressure generated by a bellows, or by manually squeezing the tank in order to force an incompressible coolant through the coolant supply. Suitably, the tank can be designed as fashionable accessories.

The coolant reservoir may however also be formed by an internal tank that is positioned e.g. within the headband and has incorporated therein for controlled escape of coolant small perforations which are fluidity connected to the wettable surface area so that the evaporative zones can be kept moist solely by the capillary action.

According to another feature of the present invention, the head covering portion defines an interior space which is lined with a layer of heat-dissipating material, e.g. a metal foil, to evenly and effectively transmit the person's body heat as well as heat, which collects under the head covering portion and is generated during sun exposure, to the evaporated zones. Thus, moisture is prevented from wetting the person's head. This kind of heat transfer can be further enhanced when also designing the brim surface of the headgear, such as sunhat or cap, as wettable evaporative zone, whereby embedded in the brim is a heat-dissipating layer which is conductingly connected with the heat-dissipating layer lined along the inside surface of the head covering portion. Suitably, part of the heat-dissipating layer may be designed in the form of a headband that directly bears upon the person's forehead so that the body heat can be carried off directly into the heat-dissipating layer.

According to another feature of the present invention, the headgear includes an additional neck band which exhibits a wide section in the area of the neck for direct contact upon the skin and is made of a heat-dissipating material which may be conductingly connected with the heat-dissipating material of the main body or may be cooled via wettable evaporative zones on the outside.

The headgear, or at least part thereof, may be made of a fabric that transports moisture only in one direction, i.e. from inside towards the outside. Examples for such a material include terry cloth or velour which has embedded therein strands of microfibers. Microfibers are microfilaments, typically textured plastics filaments of polyamide or the like. In general, loops of microfibers exhibit a higher absorbency than loops of cotton or other textile materials, and thus rapidly absorb moisture to carry it outwards. Examples of such materials are disclosed in German Pat. No. DE 42 00 276 C1.

Preferably, the headgear is formed as headband which is wetted and kept moist via an internal or an external coolant reservoir. In this manner, the person's head remains comfortably cool as soon as the headgear is worn.

Advantageously, the headgear according to the present invention includes two internal tanks positioned laterally on the main body in opposition to one another to thereby balance the weight and prevent a displacement of the headgear. It is certainly also possible to arrange one tank on the front end and one tank at the back end of the headgear, or to arrange several tanks that are evenly spaced about the circumference.

Suitably, the internal or external tanks may be formed with several connectors to enable attachment of other carried items, such as for example cooling bags operating on the basis of evaporation cooling, or attachment of a headgear of a second person.

According to another feature of the present invention, the headgear may include a solar cell which is secured to the main body or to the coolant reservoir and which is operatively connected to an electric pump which is mounted in the coolant reservoir or in the coolant supply. As a consequence of increasing sun exposure, the evaporation rises and thus also the flow rate of the pump so that the cooling effect can be adjusted in dependence on the exposure to sun.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
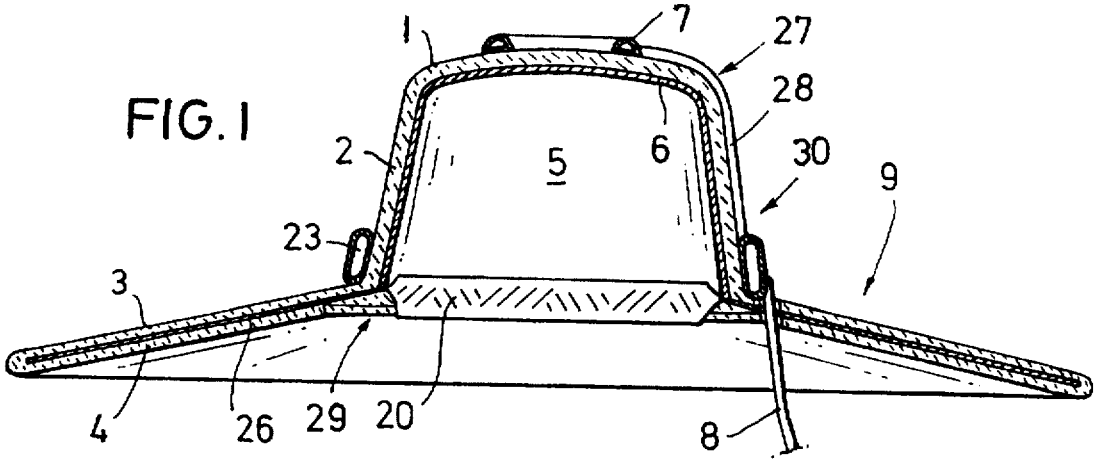
FIG. 1 is a side elevational view of one embodiment of a headgear according to the present invention in the form of a sunhat.
Figure 2:
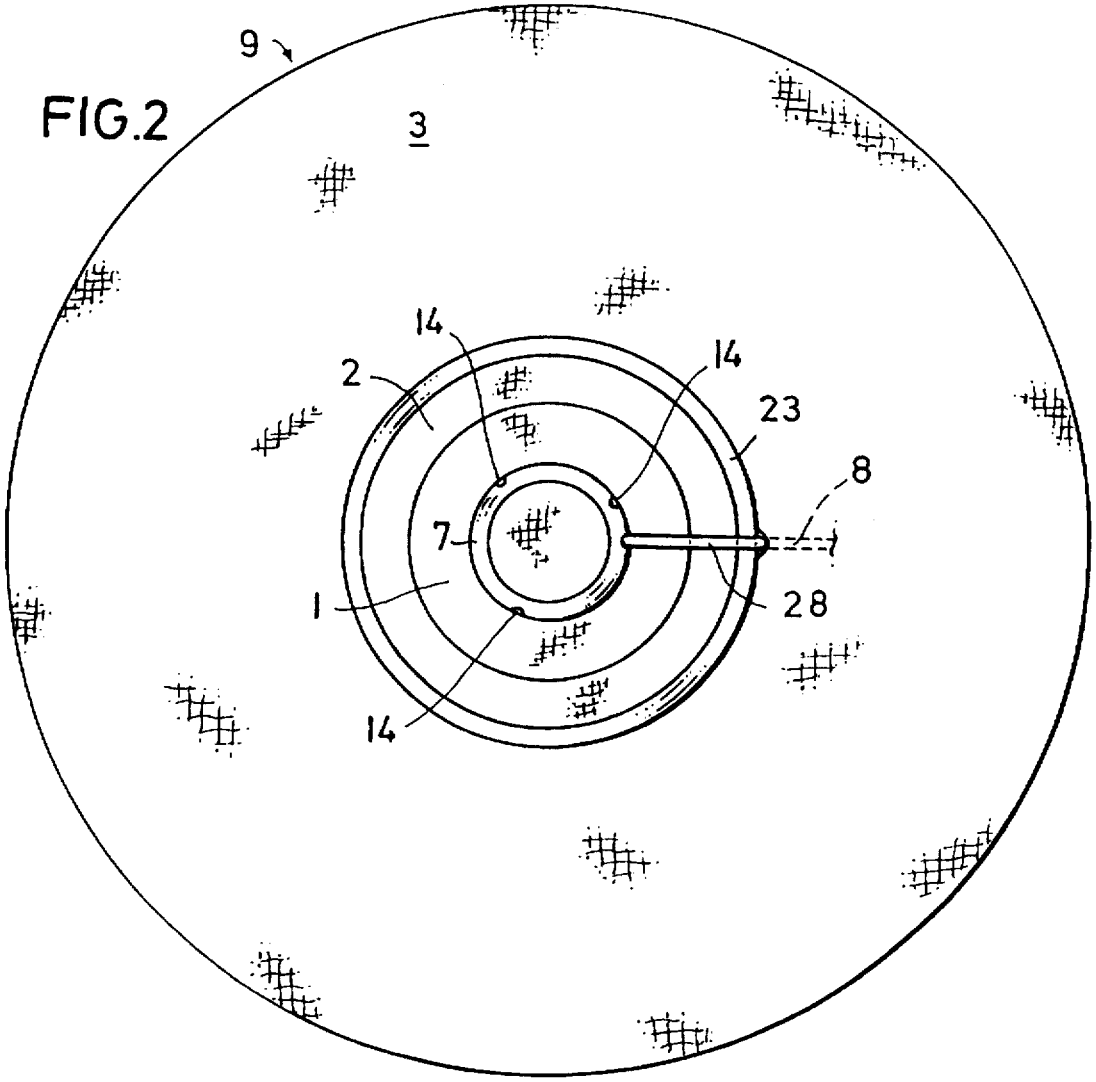
FIG. 2 is a fragmentary top plan view of the sunhat of FIG. 1.

Referring now to the drawing, and in particular to FIGS. 1 and 2, there are shown a side elevational view and top plan view of one embodiment of a headgear according to the present invention in the form of a sunhat. The headgear includes a main body generally designated by reference numeral 30 and having a head covering portion or crown 27 and a brim 9 which extends outwardly from the crown 27. The main body 30 is made essentially of a wettable material such as fabric or nonwovens so as to provide the crown 27 with evaporative zones 1 and 2, and the brim 9 with evaporative zones 3 and 4, with evaporative zone 3 facing upwards and the evaporative zone 4 facing downwards toward the person's head.

The crown 27 defines an interior space 5 which is cooled by utilizing the latent heat absorbed by water vapor during vaporization of liquid water. In order to improve the evaporative cooling, the inside surface of the crown 27 is lined with a layer 6 of heat conducting material, e.g. a metal foil, and embedded within the brim 9 is a layer 26 of heat conducting material which is conductingly connected to the layer 6 so that more heat can be carried off from the interior space 5 in the crown 27. At the junction between the crown 27 and the brim 9, the main body 30 includes a sweat band 29 which includes a contact area 20 for placement upon a person's forehead and is made of heat-dissipating material to further increase the cooling action. Suitably, the contact area 20 is made of a metal braid to allow also air to reach the person's skin.

The headgear is further provided with a coolant supply unit which includes a coolant reservoir 23 secured around the crown 27 e.g. via a rubber band or the like, and connected via a tube 8 to an external coolant-containing tank (not shown) for supply of coolant from the tank. The tube 8 may certainly also be used as fill-in connection for introducing coolant. Placed on top of the crown 27 is a thin tubing 7 of ring-shaped configuration which is fluidly connected to the reservoir 23 by a tubing 28. The tubing 7 is preferably guided within channels formed by fabric strips sewed onto the headgear and is formed with fine apertures 14 (FIG. 2) which are spaced about its circumference to allow escape of small amounts of water toward the evaporative zone 1 of the crown 27. Although not shown in detail, the internal coolant reservoir 23 may also formed with small apertures which are in fluid communication with the evaporative zones 2, 3, 4, so that the main body is moistened solely by capillary force.

Figure 3:
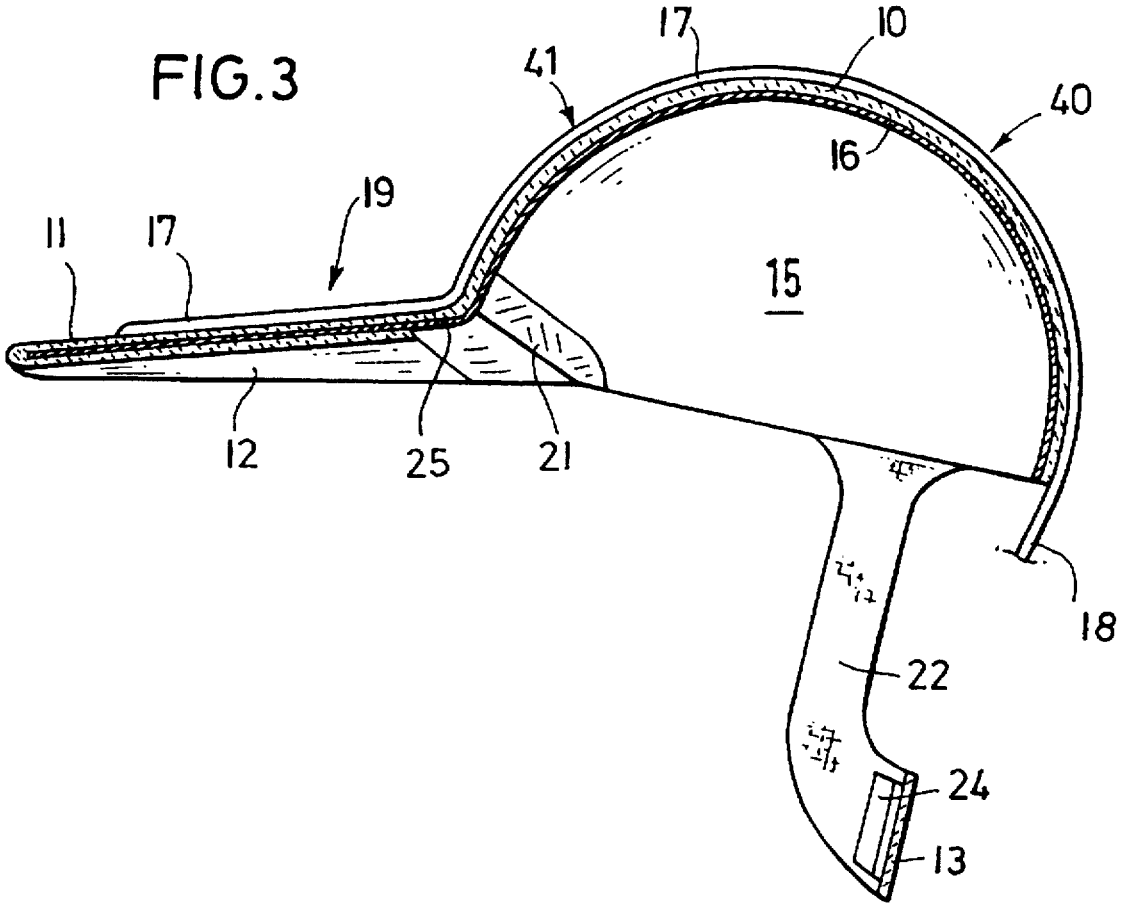
FIG. 3 is a side elevational view of another embodiment of a headgear according to the present invention in the form of a cap.
Figure 4:
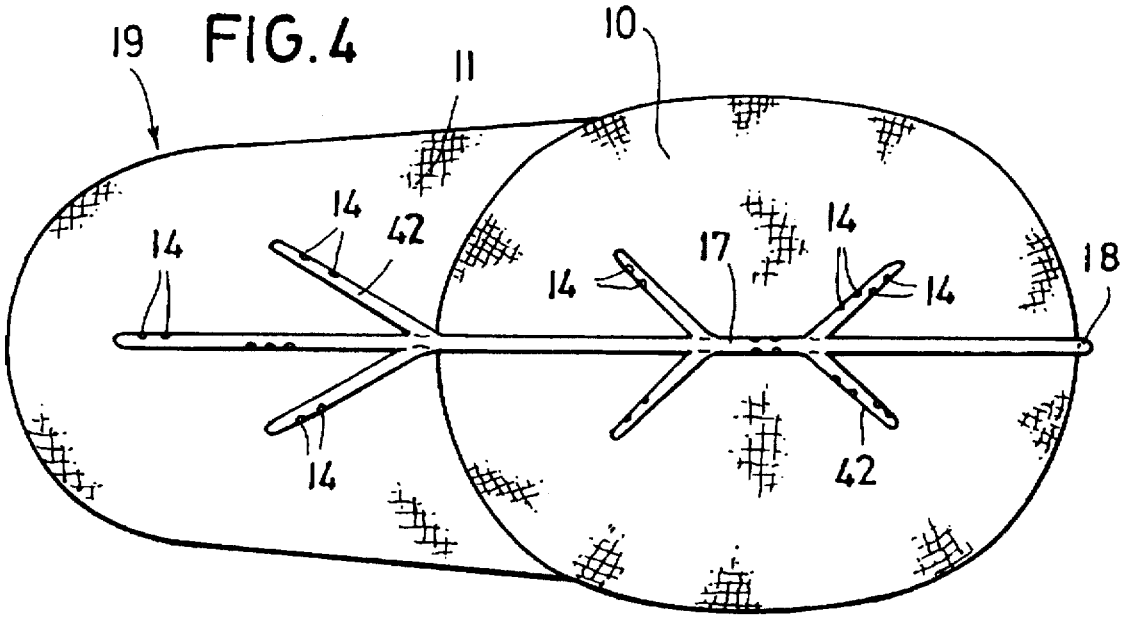
FIG. 4 is a plan view of the cap of FIG. 3.

Turning now to FIGS. 3 and 4, there are shown a side elevational view and a plan top view of another embodiment of a headgear in the form of a cap, having a main body 40 which includes a head covering portion 41 and a brim or visor 19 extending outwardly from the head covering portion 41. The main body 40 is substantially made of wettable fabric or nonwovens so as to exhibit over its entire surface evaporative zones 10, 11, 12. An additional evaporative zone 13 is formed on a neck band 22 which extends downwards from the head covering portion 41.

The head covering portion 41 defines an interior space 15 and is lined along the inside wall surface thereof with a layer 16 of heat-dissipating material, e.g. a metal foil. In addition, the brim 19 has embedded therein a layer 25 of heat-conducting material which is conductingly connected to the layer 16 along the inside of the head covering portion 41. Thus, the interior space 15 of the cap is cooled by an evaporative cooling effect which is further enhanced by the provision of a headband 21 secured to fie main body 40 at the junction between the head covering portion 41 and the brim 19 for contact on a person's forehead. Suitably, also the neck band 22 is formed with a wide layer 24 of heat-dissipating material at least in the neck area.

The coolant supply is effected by a tubing 17 that is directed centrally around the top surface of the head covering portion 41 and continues over the brim 19 to terminate shy of the forward edge of the cap. The tubing 17 is preferably guided within channels formed by fabric strips sewed onto the headgear and includes branches 42 to increase the area for conduction of coolant to the evaporative zones 10, 11, 12. At the brim-distant end, the tubing 17 is connected to a hose 18 to allow introduction of coolant or connection to an external coolant reservoir (not shown). As shown in particular in FIG. 4, the tubing 17 and the branches 42 are formed with small apertures 14 to allow small amounts of water to pass therethrough.

Figure 5:
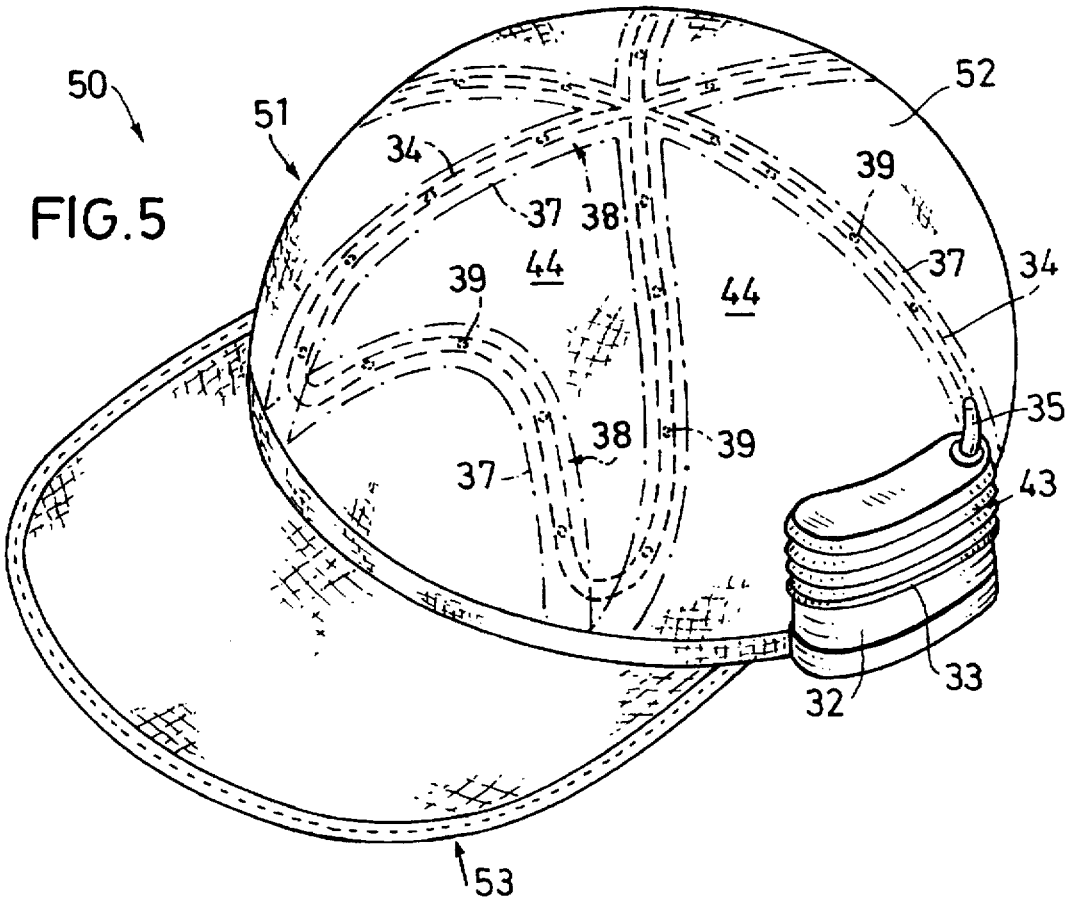
FIG. 5 is a top, front perspective view of another embodiment of a headgear in form of a cap.

Turning now to FIG. 5, there is shown a top, front perspective view of another embodiment of a headgear in form of a cap, generally designated by reference numeral 50 and having a main body 51 which includes a head covering portion 52 and a brim or visor 53 extending outwardly from the head covering portion 52. The head covering portion 52 is made of a terry material of cotton fabric in combination with filaments of microfibers, preferably made of polyamide. The filaments of microfibers are so embedded within the terry as to transport moisture to the outside when the terry is wetted with water.

Placed laterally on and secured by an elastic band 33 to the head covering portion 52 is a liquid tank 32 which is formed with an adapter 35 for connection of a tube 34. The tube 34 extends along the inside of the head covering portion 52 in a snake-like formation and is guided within fabric strips 37 that are sewed along their longitudinal edges to the inside of the head covering portion 52 and form channels 38 for the tube 34. Suitably, the fabric strips 37 are made of skin-friendly and body-friendly material. In order to allow a passage of fluid (e.g. water) to the evaporative zones 44 of the head covering portion 52, apertures 39 are formed in the tube 34 along its length. At its adapter-distant end (not shown), the tube 34 is sealed shut.

The fluid tank 32 contains water for supply through the tube 34 and is made of any suitable elastic plastic material. At its upper area, the tank 32 is formed with a bellows 43 to allow a compression of the tank 32 and thereby output of water which is transported through the tube 34 and escaped via the apertures 39. As the filaments of microfiber exhibit a greater absorbency compared to the loops of cotton, water is rapidly absorbed by the microfiber filaments and transported outwardly to the evaporative zones 44. Evaporation of water removes heat from the surroundings to thereby effect a cooling action. The terry material with incorporated filaments of microfibers ensures a cooling of the person's head wearing the headgear without wetting the head, scalp or hair.

Figure 6:
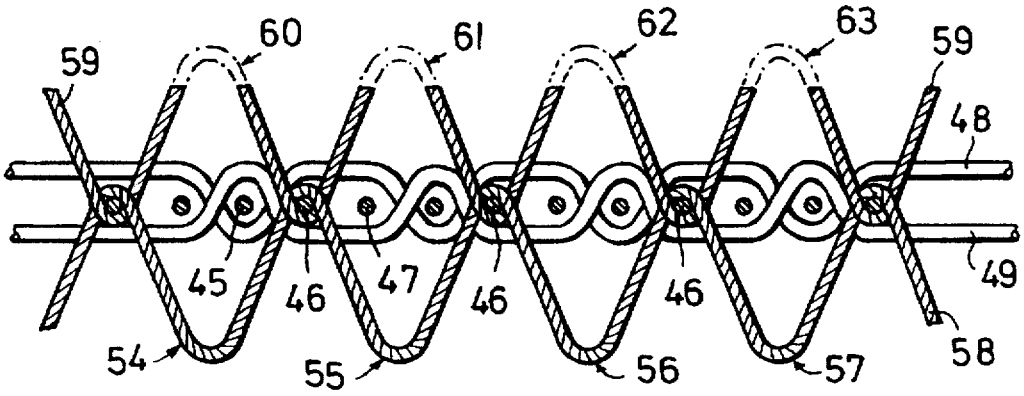
FIG. 6 is a fragmentary, schematic longitudinal section, on an enlarged scale, of a section of the headgear of FIG. 5, showing in detail the composition of the material thereof.

FIG. 6 is a fragmentary, schematic longitudinal section, on an enlarged scale, of a section of the headgear of FIG. 5, showing in detail the composition of the material of the head covering portion 52. In this context, reference is made to German Pat. No. DE 42 00 278 C1, which describes example of suitable terry or velour for use with a headgear according the present invention. FIG. 6 shows a section of the terry parallel to the warp i.e. perpendicular to the plane of the weft. Reference numerals 45, 46 47 designate filling threads which cross alternatingly warp threads 48, 49. The formation of cotton loops 54, 55, 56, 57 is effected by providing loop warp threads 58 between the warp threads 48, 49 which are wound about the filling threads 46 and are pulled outwards toward the lower side of the material web in the illustration of FIG. 6. In addition, loop warp threads 59 of filaments of microfibers are provided which are wound about the filling threads 46 and form the loops 60, 61, 62, 63 at the upper side in opposition to the cotton loops 54, 55, 56, 57. The loops 60, 61, 62, 63 of filaments of microfibers exhibit a significantly greater absorbency than the loops 54, 55, 56, 57 of cotton so as to rapidly absorb moisture and transport it to the outside to the evaporative zones 44.

Suitably, in the headgear 50 according to FIG. 5, the terry material of the head covering portion 52 is so disposed that the loops 60, 61, 62, 63 of microfiber filaments are positioned on the inside to immediately absorb moisture while the cotton fabric is positioned on the outside of the head covering portion 52. It is also feasible to shear the terry so that the loops 60, 61, 62, 63 are cut open, as indicated in FIG. 6 by way of broken lines.

While the invention has been illustrated and described as embodied in a headgear, it is not intended to be limited to the details shown since various modifications and structural changes may be made without departing in any way from the spirit of the present invention.

What is claimed as new and desired to be protected by Letters Patent is set forth in the appended claims:

1. A headgear to be worn on the head of a person, in particular a sunhat or a cap, comprising:

a main body including a head covering portion and an outwardly extending brim, said main body having a free outer surface area exhibiting wettable properties over at least part thereof to define an evaporative zone; and a coolant supply unit for feeding a coolant from a coolant reservoir to the evaporative zone such that coolant is able to escape through evaporation, said coolant supply unit including a tube connection linking the coolant reservoir to the evaporative zone.

2. The headgear of claim 1 wherein the coolant is water.

3. The headgear of claim 1 wherein the coolant reservoir is a tank secured to the main body.

4. The headgear of claim 3 wherein the tank is formed with fine apertures fluidly connected to the evaporative zone of the surface area for escape of coolant when momentarily setting the tank under pressure to thereby continuously supply the evaporative zone with coolant and keep it moist.

5. The headgear of claim 1 wherein the coolant reservoir is an external tank.

6. The headgear of claim 5 wherein the external tank is designed to be supported on a person's body, with the coolant being contained in the tank under pressure.

7. The headgear of claim 6 wherein the external tank is a container in the form of a shoulder bag, belt bag, bracelet, or necklace.

8. The headgear of claim 5 wherein the external tank is designed as fashionable accessories.

9. The headgear of claim 1 wherein the tube connection includes a tube formed with fine apertures fluidly connected to the evaporative, zone for escape of coolant so that through capillary action the evaporative zone is continuously supplied with coolant and kept moist.

10. The headgear of claim 9 wherein the tube is a branched tube.

11. The headgear of claim 9 wherein the apertures are formed laterally in the tube.

12. The headgear of claim 1 wherein the head covering portion defines an interior space, and further comprising a heat-dissipating lining covering at least part of the interior space.

13. The headgear of claim 12, and further comprising a heat-dissipating layer disposed within the brim beneath the evaporative zone and conductingly connected to the lining in the interior space.

14. The headgear of claim 12 wherein part of the lining is formed as wide head support.

15. The headgear of claim 1 wherein the head covering portion has an inside wall surface which along areas in direct contact with the head of the person is so insulated from the evaporative zone as to be protected from moisture.

16. The headgear of claim 1 wherein the main body has a neck band portion which is made, at least partially, of wettable material to define an evaporative zone, said neck band portion being provided at least in an area of a person's neck with a heat-dissipating material forming a wide neck support.

17. The headgear of claim 1 wherein the main body is made of a material selected from the group consisting of fabric, nonwoven and a material permitting transport of moisture only in a direction from inside to outside.

18. The headgear of claim 1, and further comprising a solar cell secured to at least one element selected from the group consisting of the main body and the coolant reservoir, and an electric pump for conveying the coolant and positioned in at least one element selected from the group consisting of the coolant reservoir and the tube connection, with the solar cell and the pump being electrically connected to one another.

19. The headgear of claim 1 wherein the main body is configured in the form of a headband.

20. The headgear of claim 1 wherein the coolant supply unit includes two coolant tanks secured laterally to the main body in opposition to one another.

21. The headgear of claim 1 wherein the coolant reservoir exhibits a plurality of connections to allow attachment of objects carried by a person.

22. The headgear of claim 1 wherein the coolant supply unit includes a fabric strip forming a channel for receiving the tube connection.

23. The headgear of claim 1 wherein the tube connection includes a snake-like tube extending inside of the head covering portion.

24. The headgear of claim 1 wherein the head covering portion is made of a terry material having embedded therein filaments of microfibers.

25. The headgear of claim 24 wherein the terry material has warp threads made of filaments of microfibers.

* * * * *